United States Patent [19]

Clayton

[11] Patent Number: 4,519,095

[45] Date of Patent: May 21, 1985

[54] ADHESIVE CHANNEL CLOSURE FOR FLEXIBLE BAGS

[75] Inventor: William J. Clayton, Fairport, N.Y.

[73] Assignee: Mobil Oil Corporation, New York, N.Y.

[21] Appl. No.: 559,846

[22] Filed: Dec. 9, 1983

Related U.S. Application Data

[63] Continuation of Ser. No. 335,798, Dec. 30, 1981, abandoned.

[51] Int. Cl.[3] ..... B65D 33/20

[52] U.S. Cl. ..... 383/86; 383/42

[58] Field of Search ..... 383/62, 63, 86, 42, 383/95; 206/260, 632

[56] References Cited

U.S. PATENT DOCUMENTS

| | | | |
|---|---|---|---|
| Re. 28,969 | 9/1976 | Naito | 150/3 |
| 3,060,985 | 10/1962 | Vance et al. . | |
| 3,226,787 | 1/1966 | Ausnit . | |
| 3,279,331 | 10/1966 | Platt | 383/86 X |
| 3,339,606 | 9/1967 | Kugler . | |
| 3,420,433 | 1/1969 | Bostwick . | |
| 3,990,627 | 11/1976 | Olson . | |
| 4,186,786 | 2/1980 | Kirkpatrick | 150/3 |

*Primary Examiner*—William I. Price
*Assistant Examiner*—Sue A. Weaver
*Attorney, Agent, or Firm*—Alexander J. McKillop; Michael G. Gilman; Charles J. Speciale

[57] ABSTRACT

A closure suitable for use with a flexible bag, such as a sandwich bag where the closure comprises at least one female strip affixed to a first surface, the channel having a layer of pressure sensitive adhesive less than the depth or the interior height of the channel and located on an internal portion of the channel, and a second surface, whereby the seal is formed by contacting the pressure sensitive adhesive layer in the channel with a portion of the second surface.

19 Claims, 6 Drawing Figures

ADHESIVE CHANNEL CLOSURE FOR FLEXIBLE BAGS

This is a continuation of copending application Ser. No. 335,798, filed on Dec. 30, 1981, abandoned.

BACKGROUND OF THE INVENTION

1. Field of the Invention

The present invention relates to closures suitable for use with flexible bags, such as sandwich bags made out of polyethylene film. Related applications assigned to the same assignee as this application include the following copending and concurrently filed applications: "Adhesive Bag Closure that Opens Easily By Hand But Resists Opening By Contents", Ser. No. 335,800, filed Dec. 30, 1981, abandoned; "Protective Strip for Z-Fold Bag Closure", Ser. No. 335,955, filed Dec. 30, 1981, U.S. Pat. No. 4,410,130 "Manufacturing Process for Channel Seal", Ser. No. 365,814, filed Apr. 5, 1982, U.S. Pat. No. 4,392,897; and "Laminated Pressure Sensitive Adhesive Systems for Use in Plastic Bags", Ser. No. 335,799, U.S. Pat. No. 4,415,087, filed Dec. 30, 1981, the last application being incorporated by reference herein.

2. Brief Description of the Prior Art

A number of closure arrangements have been used to seal and/or close plastic bags such as those used for sandwiches, garbage containers, and other household uses. These previous attempts include the so-called profile bags where the closure comprises one or more sets of mating channels. Each channel may be formed as an integral part of the bag or fabricated as a separate piece and attached to the bag. One example of a profile closure is the Zip-loc storage bag as found in U.S. Pat. No. 28,969 to Naito. For examples of other profile bags see U.S. Pat. No. 3,226,787 to Ausnit and U.S. Pat. No. 3,060,985. As seen in U.S. Pat. No. 4,186,786 to Kirkpatrick, colored channels have been used to allow the user to more easily detect complete occlusion of profile bag openings. In order to achieve satisfactory use with profile bag closures, however, the mating members must fit properly and be aligned correctly. It may take several attempts at closing the bag before proper registration of the mating members is finally achieved. Bags with profile closures also tend to be an expensive choice for uses which do not require the containment of liquids.

Other types of bag closures use one or more adhesive strips. Problems with such adhesive closures include weak shear strength because the exposed adhesive for a strip must be selected to be weak enough so that it does not undesirably stick to other bags while on a roll or in a box.

An attempt to combine a profile closure with an adhesive may be seen in U.S. Pat. No. 3,339,606 to Kugler. The releasable closure in the Kugler patent comprises a tongue on one member and a groove on the other member where the tongue is of a thickness less than the width of the groove and wherein a releasable pressure sensitive adhesive is provided to keep the tongue within the groove. This structure, however, still requires registration of mating channels.

Attempts have also been made to protect the adhesive strip until the bag is used. In U.S. Pat. No. 3,420,433 to Bostwick a closure flap having an adhesive applied thereto is folded or overflapped upon itself to form a protective enclosure for the adhesive prior to the use of the bag. In U.S. Pat. No. 3,990,627 to Olson (and assigned to the same assignee as this application), a Z-fold adhesive closure for bags is disclosed wherein the adhesive strip is covered by the upper portion of the bag's front wall until ready for use. It is difficult, however, to find an adhesive which is easy to apply, which is strong enough to form an effective seal upon closure, but which does not cause undesirable problems by sticking to other bags or miscellaneous surfaces.

In the pressure sensitive adhesive art, the solution to the problem of sticking during shipment and storage has been to provide a release layer over the pressure sensitive adhesive. For example, pressure sensitive plastic tapes have a release layer which impedes the sticking of the adhesive to the plastic of the adjacent layer in the roll. This approach is not desirable on closures for plastic bags because of expense and difficulty in manufacture.

Thus, it is an object of the present invention to provide closures suitable for use with plastic bags wherein the closures are able to effect a satisfactory seal as needed, without sticking to other bags while in storage. It is a further object of this invention to provide a closure suitable for use with flexible bags where a more powerful adhesive may be utilized without interfering with the storage of the bag on a roll. It is yet another object of this invention to provide closure seals for use with flexible bags wherein mating contact between flap and front is not needed to effect closure. It is a further object of this invention to provide a flexible bag with an openable and resealable closure. It is another object still to provide a closure for a flexible bag in which the bag may be fitted to the object contained therein and the closure may be used to maintain the fit. It is another object of this invention to provide a flexible bag with a resealable closure which exhibits good shear strength. These and other objects of the invention will be apparent from the following description.

SUMMARY OF THE INVENTION

The present invention provides a closure suitable for use with flexible bags, such as thermoplastic bags, especially those made from polyethylene, wherein the closure comprises at least one female channel member or strip affixed to the bag and having a pressure sensitive adhesive layer on an internal portion of the channel strip such that the thickness of the adhesive layer is less than the interior depth of the walls of the channel strip. During shipment and storage the walls of the channel hold the pressure sensitive adhesive layer away from adjacent surfaces to prevent inadvertent sticking. Sealing of the bag is achieved by contacting the channel strip with a surface of the bag and exerting pressure along the strip whereby the pressure sensitive adhesive is contacted with a substantially flat portion of the surface and adhered thereto.

In one embodiment of the invention the channel with the adhesive layer is positioned on the flap of the bag. In a second embodiment the channel with the adhesive is positioned on the body of the bag over which the flap will fold.

A third embodiment comprises two female channel strips positioned on opposite sides of a bag opening. A double seal is effected by pressing the two channels into contact such that one wall or bead of each channel is contacted by the adhesive layer in the opposing channel.

DETAILED DESCRIPTION OF THE DRAWINGS

Figure 1:
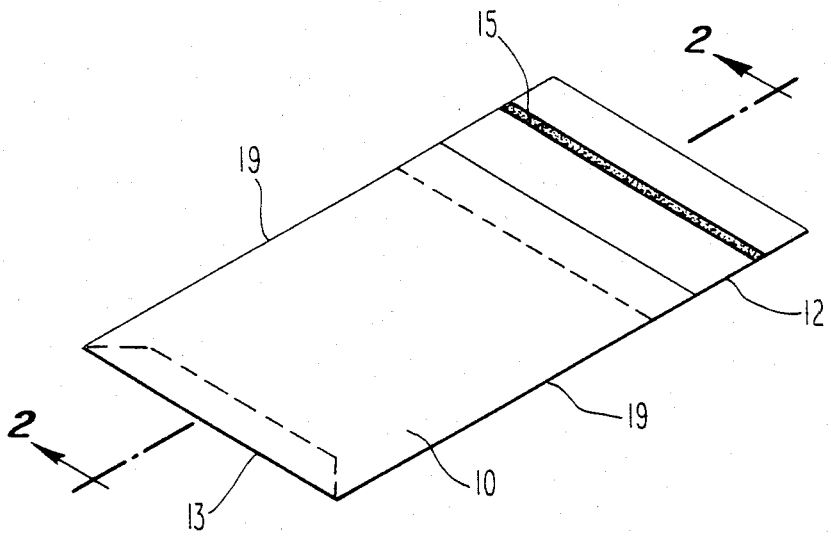
FIG. 1 is an elevational view of a flat sandwich bag having a closure constructed in accordance with this invention.
Figure 2:
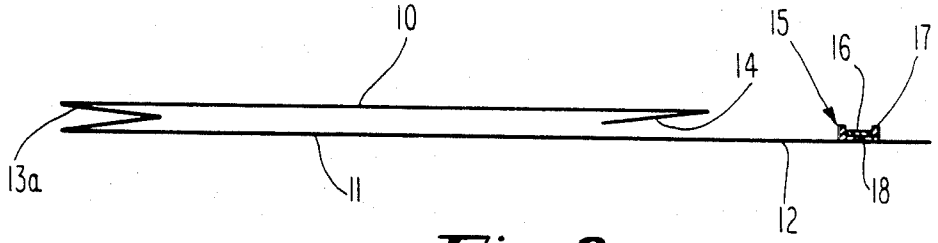
FIG. 2 is a cross-section of FIG. 1 taken along line 2—2.

FIGS. 1 and 2 show a sandwich bag having a closure constructed in accordance with this invention. A bag or bag body comprises a front wall 10 overlying a back wall 11 from which a flap portion 12 extends. Front wall 10 is attached to back wall 11 along longitudinal edges 19 and bottom 13, thereby forming an open mouth adjacent to the top edge of the front wall. The bag may be constructed with a gusset 13*a* and an interior fold of film or flap 14 to better accommodate the thickness of an object such as a sandwich. The bag is preferably made out of a plastic film such as polyethylene. Flap 12 has a female channel strip 15 positioned thereon at a preselected distance from the opening. This channel 15 has walls or ribs 17 and a base 18 which comprise a trough. Preferably base 18 is a layer formed integrally with walls 17. Channel 15 may be fabricated in a separate step and applied to the flap 12 or it may be formed as an integral part of flap 12, e.g., by a heat deformation process. Interior to channel 15 is a layer of pressure sensitive adhesive 16, the thickness of which should be less than the interior height of the walls or ribs 17 of channel 15 (as will be explained in more detail below in FIG. 4) and which should preferably be applied to the bottom or base portion 18 of channel 15. Preferably layer 16 is continuous or uninterrupted. Sealing of the bag is effected by folding flap 12 over a substantially flat portion of front member 10 until the bag is positioned around an object contained therein, and pressure is applied along the area where channel strip 15 is contacted with front member 10 thereby spreading the channel walls 17 open and contacting the adhesive 16 with a sectional strip of front member 10.

Figure 3:
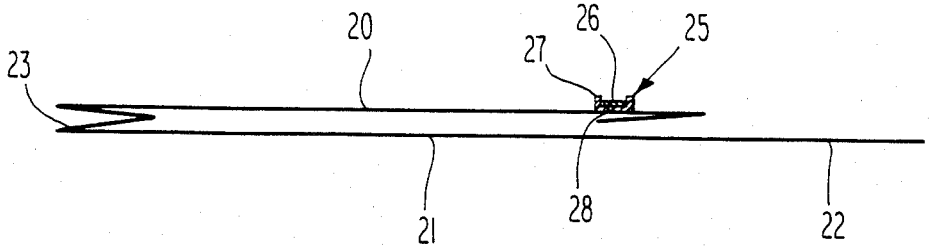
FIG. 3 is a cross-section of a second embodiment in which the channel adhesive strip is placed on the surface of the bag over which the flap will fold.

FIG. 3 shows a cross-section of a second embodiment of this invention in which front wall 20 and back wall 21, with optional gusset 23 and an interior fold of film or a flap 24, form a bag or bag body. Flap 22 extends from back member 21. A female channel member 25 with walls 27 and base 28 is positioned on front wall 20. A layer of adhesive 26 is placed interior to channel walls 27 in a trough preferably on the bottom or base 28 of channel 25 such that the thickness of the layer of adhesive 26 is less than the interior height of walls 27 when in an unsealed position. Sealing is effected by positioning flap 22 over channel 25, exerting pressure to spread apart walls 27 thereby contacting a substantially flat section of flap 22 with adhesive layer 26.

Figure 4:
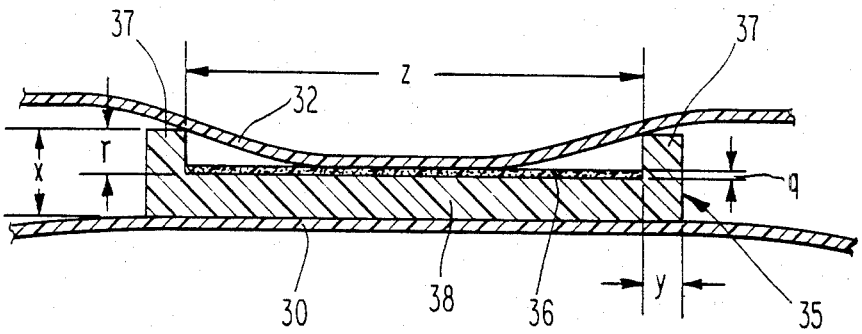
FIG. 4 is a sectional view of an enlarged cross-section of the closure in a sealed position.

FIG. 4 shows a sectional view of an enlarged cross-section of the closure of this invention in a sealed position in which female channel strip 35 with adhesive layer 36 on an internal portion of the channel strip 35 in the trough, is positioned on a surface 30 so that channel 35 faces away from the surface. A second surface 32 has been contacted with the adhesive layer 36 contained in channel strip 35 and has been pressed into the trough of the channel and into intimate contact with the adhesive layer, thus effecting sealing of the closure. While the portion of surface 32 that is contacted with adhesive layer 36 was initially substantially flat, some deformation has taken place as may be seen in FIG. 4. The amount of adhesive contained in the channel structure may be varied as desired, but it should not exceed the interior height r of the walls 37 of channel structure 35 when in an unsealed position. The layer of adhesive 36 may be coated into channel structure 35 either as a continuous layer or as an interrupted layer, but is preferably applied at the bottom or base 38 as a continuous layer.

A variety of dimensions may be used for the exterior height x and thickness y of channel wall 37, interior width z of channel structure 35, and thickness q of adhesive layer 36. In a particularly preferred embodiment an extruded strip comprising polyethylene is applied to a polyethylene sandwich bag surface by means of a hot melt technique. A ribbon of pressure sensitive adhesive is positioned between the walls or ribs of the strip. The channel or ribbon structure is constructed so that the height x of the walls of the channel is about 40 mils high and the distance z between channel wall 37 is about one-quarter inch apart. The thickness y of each channel wall 37 is constructed to be about 20 mils, the thickness q of pressure sensitive adhesive layer 36 is a coating approximately one mil thick, and the surface layer 30 of polyethylene is about five mils thick.

Figure 6:
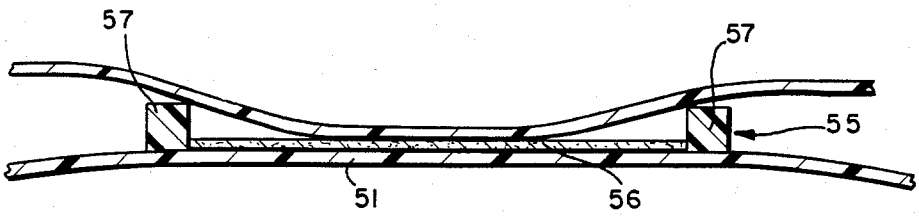
FIG. 6 is a sectional view of an enlarged cross-section of an alternative embodiment of the closure in a sealed position.

In an alternate embodiment shown in FIG. 6, a set of two extruded beads or ribs 57 may also be used to form a channel strip 55 analogous to the embodiment shown in FIGS. 2–4. The channel strip 55 of such an embodiment would have a base 51 comprising a portion of the film surface between the two beads 57, and a layer of adhesive 56 would be positioned on the surface within the area defined by the beads 57.

Figure 5:
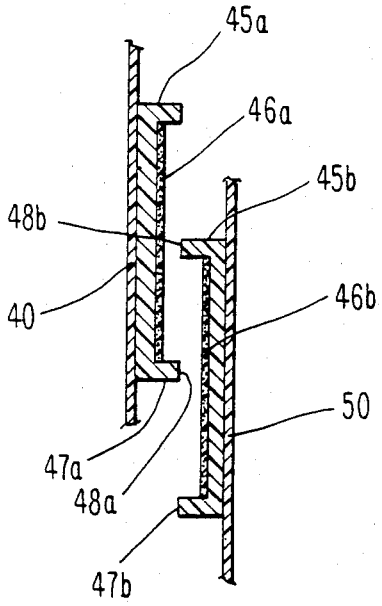
FIG. 5 is a sectional view of an enlarged cross-section of a third embodiment in which two opposing female channel strips are used.

FIG. 5 shows a third embodiment of this invention comprising two female channel members, 45*a* and 45*b*. The first female channl strip 45*a* is positioned on a surface 40. First channel strip 45*a* has a wall 47*a*. A layer of pressure sensitive adhesive 46*a* is positioned interior to first channel strip 45*a* and should be less than the interior height of first channel strip 45*a* when in an unsealed position. A second female channel strip 45*b* is constructed to be substantially identical to the first channel strip with channel walls 47*b*, and adhesive layer 46*b*. The second channel member is positioned on second surface 50. The bag may be closed so that one seal is formed between a portion of the adhesive layer 46*a* and the top portion 48*b* of a channel wall 47*b*, and a second seal is formed between a portion of the adhesive layer 46*b* and the top portion 48*a* of a channel wall 47*a*.

Alternatively, each of the female channel strips 45*a* and 45*b* may be formed as shown in FIG. 6 by extruding two beads 57, positioning them on a bag closure surface 51 a preselected distance apart, and applying the adhesive layer 56 directly to a portion of the surface of the film which is between the two beads 57. Particularly preferred dimensions for this alternate embodiment are beads 10 mils in diameter spaced from about 3/32 inch to about 3/16 inch apart with an adhesive layer at least about 1 mil thick. The beads should be made from a relatively soft material comprising polyethylene with little or no slip additive. Adhesives having good peel strength are also preferred.

The closures of this invention are also useful with adhesive systems such as those comprising at least two layers of adhesive material as found in copending application Ser. No. 335,799, filed Dec. 30, 1981, U.S. Pat. No. 4,415,087 entitled "Laminated Pressure Sensitive Adhesive Systems for Use in Plastic Bags".

Additives may be used in the channel composition to improve adherence to the bag. In an especially preferred embodiment, a bag body comprising polyethylene is used with a separately extruded channel structure of the type seen in an enlarged view in FIGS. 4 and 5. The channel structure comprises about 83% by weight polyethylene and about 17% by weight ethylene vinyl acetate (e.v.a.) and is separately extruded and applied to a portion of the bag surface.

The closures of this invention afford protection of the adhesive material when not in use, and allow a stronger adhesive to be used since the adhesive layer is protected against accidental contact with other surfaces. Since a stronger adhesive can be used, the surface pressed into contact with the adhesive layer is not profiled and thus does not need to achieve registration with the channel structure in which the adhesive layer is present.

Pluralities of these closures may also be used so that a bag may have two or more closure structures. The channel strips may optionally be colored in order to more easily locate their position on the bag.

Although specific embodiments of the present invention have been described it is to be understood that modifications and variations may be found by those skilled in the art which are within the spirit and scope of the invention.

What is claimed is:

1. A flexible thermoplastic bag comprising:

a front wall and a back wall, said walls being joined along the major portion of their opposite longitudinal edges and bottom;

an open mouth adjacent to the top edge of said front wall, said open mouth of said bag having a flap which is an extension of the back bag wall and having longitudinal edges which are not joined to the upper edges of said back wall; and a closure comprising:

a female channel strip affixed to a surface of one of said front wall or said flap at a preselected distance from said opening, said channel strip having a trough between two spreadable channel ribs wherein the height of the interior walls of said channel ribs is about 40 mils, the distance between the interior walls of said channel is about one-quarter inch, and the thickness of each of said channel ribs is about 20 mils; and a pressure sensitive adhesive layer in said trough, the thickness of said adhesive layer being less than the interior height of said channel ribs, said closure being positioned on said bag such that when said flap is folded over the opening of said bag, a flat deformable portion of said bag is pressable into said trough by spreading said channel ribs, whereby a seal is formed without a need for mating registration between said female channel strip and any particular portion of said flat deformable portion of said bag by contacting said pressure sensitive adhesive layer with said flat deformable portion.

2. The bag recited in claim 1 wherein said female channel strip is positioned on said flap so that when said flap is folded over said open mouth a flat portion of said front wall can be pressed into said trough whereby a seal is formed by contacting said pressure sensitive adhesive layer with said flat portion of said front wall.

3. The bag recited in claim 1 wherein said female channel strip is positioned on said front wall of said bag with said trough of said channel facing away from said front wall, so that when said flap is folded over said open mouth, a flat portion of said flap can be pressed into said trough whereby a seal is formed by contacting said pressure sensitive adhesive layer with said flat portion of said flap.

4. The bag recited in claim 1 wherein said female channel strip extends the length of said open mouth, and wherein said pressure sensitive adhesive layer is continuous in said trough, whereby a continuous seal is formed by contacting said pressure sensitive adhesive layer with said flat portion.

5. The bag recited in claim 1 wherein said channel strip comprises about 83% by weight polyethylene and about 17% by weight ethylene vinyl acetate, and wherein the bag comprises polyethylene.

6. The bag recited in claim 5 wherein the thickness of said pressure sensitive layer is about one mil.

7. The bag recited in claim 1 wherein the thickness of said pressure sensitive layer is about one mil.

8. The bag recited in claim 1 wherein said female channel strip comprises two extruded beads forming said channel ribs on said one of said front wall or said flap.

9. A releasable flexible bag comprising:

opposing first and second surfaces;

a first channel strip having a trough between two channel ribs affixed to said first surface with said trough thereof facing away from said first surface, said first channel strip having a pressure sensitive adhesive layer on an internal portion of said first channel strip in said trough, the thickness of said adhesive layer being less than the interior height of said first channel strip; and a second channel strip having a trough between two channel ribs positioned on said second surface with said trough thereof facing away from said second surface, said second channel strip having a pressure sensitive adhesive layer on an internal portion of said second channel strip such that the thickness of said adhesive layer in said second channel strip is less than the interior height of said second channel strip;

said second channel strip being parallelly offset from said first channel strip, whereby one of said channel ribs of said first channel strip is seated in the trough of said second channel strip and one of said channel ribs of said second channel strip is seated in the trough of said first channel strip to releasably seal said flexible bag.

10. The bag recited in claim 9 wherein each of said channel strips comprises two extruded beads forming the respective channel ribs on the respective one of said first and second surfaces.

11. A flexible thermoplastic bag comprising an open mouth, at least one female channel strip affixed to a first surface at a preselected distance from said open mouth, said channel strip having a trough between two spreadable channel ribs wherein the height of the interior walls of said channel ribs is about 40 mils, the distance between the interior walls of said channel is about one-fourth inch, and the thickness of each of said channel ribs is about 20 mils, said trough facing away from said first surface, a pressure sensitive adhesive layer on an internal portion of said channel strip in said trough, the thickness of said adhesive layer being less than the interior height of said channel ribs, and a second surface having a substantially flat deformable portion which is pressable into said trough by spreading said channel ribs, whereby a seal is formed without a need for mating registration between said female channel strip and any particular portion of said flat deformable portion of said bag by contacting said pressure sensitive adhesive layer with said substantially flat deformable portion of said second surface.

12. The bag of claim 11 wherein said channel strip is fabricated as a separate member and attached to said flexible bag.

13. The bag of claim 11 wherein said channel strip is attached to a flap of said flexible bag.

14. The bag of claim 11 wherein said channel strip is attached to a front wall of said flexible bag and a rear wall of said flexible bag has a flap.

15. The bag of claim 11 wherein said channel strip comprises about 83% by weight polyethylene and about 17% by weight ethylene vinyl acetate, and wherein the bag comprises polyethylene.

16. The bag of claim 15 wherein the thickness of said pressure sensitive layer is about one mil.

17. The bag of claim 11 wherein the thickness of said pressure sensitive layer is about one mil.

18. The bag of claim 11 wherein said female channel strip extends the length of said open mouth, and wherein said pressure sensitive adhesive layer is continuous in said trough, whereby a continuous seal is formed by contacting said pressure sensitive adhesive layer with said first flat portion.

19. The bag of claim 11 wherein said female channel strip comprises two extruded beads forming said channel ribs on a front wall or a flap.

* * * * *